US007970296B2

(12) United States Patent
Shiobara

(10) Patent No.: US 7,970,296 B2
(45) Date of Patent: Jun. 28, 2011

(54) IMAGE FORMING APPARATUS WITH DEVELOPER AMOUNT DETERMINING UNIT HAVING ROTATIONAL PERIOD EQUAL TO INTEGRAL MULTIPLE OF IMAGE SUPPORTER ROTATIONAL PERIOD

(75) Inventor: Toshimasa Shiobara, Tokyo (JP)

(73) Assignee: Oki Data Corporation, Tokyo (JP)

( * ) Notice: Subject to any disclaimer, the term of this patent is extended or adjusted under 35 U.S.C. 154(b) by 54 days.

(21) Appl. No.: 12/410,892

(22) Filed: Mar. 25, 2009

(65) Prior Publication Data

US 2009/0245820 A1 Oct. 1, 2009

(30) Foreign Application Priority Data

Mar. 26, 2008 (JP) ..... 2008-081741

(51) Int. Cl.
*G03G 15/01* (2006.01)
*G03G 15/08* (2006.01)

(52) U.S. Cl. ..... 399/27; 399/167; 399/301

(58) Field of Classification Search ..... 399/27, 399/167, 159, 394, 395, 396, 301
See application file for complete search history.

(56) References Cited

U.S. PATENT DOCUMENTS

| | | | | |
|---|---|---|---|---|
| 7,778,575 | B2 * | 8/2010 | Matsuda et al. | 399/167 |
| 2007/0071464 | A1 * | 3/2007 | Yamaguchi | 399/27 |
| 2009/0190938 | A1 * | 7/2009 | Teramura | 399/27 |

FOREIGN PATENT DOCUMENTS

| | | |
|---|---|---|
| JP | A-06-161205 | 6/1994 |
| JP | A-08-137224 | 5/1996 |
| JP | A-09-146329 | 6/1997 |
| JP | A-10-333398 | 12/1998 |
| JP | A-11-258872 | 9/1999 |
| JP | A-2003-162102 | 6/2003 |
| JP | A-2004-118028 | 4/2004 |
| JP | A-2004-294471 | 10/2004 |
| JP | A-2005-037677 | 2/2005 |
| JP | A-2005-221859 | 8/2005 |
| JP | A-2006-078691 | 3/2006 |
| JP | A-2006-78691 | 3/2006 |
| JP | A-2007-163885 | 6/2007 |
| JP | A-2007-292992 | 11/2007 |
| JP | A-2007-304538 | 11/2007 |
| JP | A-2008-058726 | 3/2008 |

OTHER PUBLICATIONS

Office Action dated Nov. 9, 2009 from Japan Patent Office in corresponding JP application No. 2008-081741.

* cited by examiner

*Primary Examiner* — Sophia S Chen

(74) *Attorney, Agent, or Firm* — Posz Law Group, PLC

(57) ABSTRACT

An image forming unit includes an image supporter configured to be rotatable, and an amount detecting unit configured to rotate with a predetermined period to detect an amount of remaining developer. A rotation period of the amount detecting unit is an integral multiple of a rotation period of the image supporter.

17 Claims, 17 Drawing Sheets

AMPLITUDE MEDIAN
AMPLITUDE MEDIAN
X
R
B
Y
R=X-B-Y
B=A*Cos(Θb)
Y=A*Cos(Θy)
Θb
Θb
β
β
φ
AMPLITUDE: A
TONER SENSOR: ON
Black
TONER SENSOR: OFF
AMPLITUDE: A
TONER SENSOR: ON
Yellow
TONER SENSOR: OFF

BELT RUNNING DIRECTION

VERTICAL SCANNING DIRECTION

BACKWARD ← → FORWARD

IMAGE FORMING APPARATUS WITH DEVELOPER AMOUNT DETERMINING UNIT HAVING ROTATIONAL PERIOD EQUAL TO INTEGRAL MULTIPLE OF IMAGE SUPPORTER ROTATIONAL PERIOD

The present application is related to, claims priority from and incorporates by reference Japanese Patent Application No. 2008-081741, filed on Mar. 26, 2008.

TECHNICAL FIELD

The present invention relates generally to an image forming unit and an image forming apparatuses, particularly to an image forming apparatus such as a copier, a printer, or a fax machine that includes a plurality of the image forming units.

BACKGROUND

In a tandem color image forming apparatus, such as a color electrophotographic printer, four color image forming units are arranged in a feeding direction of a recording medium. The four color image forming units respectively form color images of black (K), yellow (Y), magenta (M), and cyan (C) on a recording medium by using toners of each color. Therefore, in such a color image forming apparatus that employs the electrophotographic method, since a toner image is formed at a shifted position instead of its proper position because of mechanism size and drive system error, image unevenness and distortion as well as a color shift in which four color toners are not positioned properly, causing the created images to be unclear. As a means to correct the color shift that occurs in the color image forming apparatus, forming a detection pattern (i.e., a toner mark), as a position shift (or positional gap) detection mark, in a predetermined interval on a carrying belt that feeds a recording medium, reading the formed detection pattern by using a detector, calculating an amount of position shift based on the reading result, and correcting an image forming position depending on the calculated amount of position shift, are performed.

When the amount of position shift is calculated by sensing the detection pattern on the carrying belt, various kinds of shifts occur depending on a position of a recording medium in the feeding direction, and an error occurs in detection of the amount of position shift. For example, when an eccentricity and rotation unevenness (i.e. change in rotation speed) occur on a photosensitive drum in the image forming unit and a driving roller of the carrying belt, the amount of position shift changes depending on each position of the recording medium in the feeding direction. In particular, when the eccentricity and the rotation unevenness occur on the photosensitive drum, the amount of position shift changes with a period of one circumference of the photosensitive drum, as a basic frequency, in each color. Therefore, the amount of shift changes depending on the sensing position.

To solve the trouble above, Japanese laid-open patent application 2006-078691 judges a relative phase difference as an optimal value of the change. The relative phase difference minimizes the change of the print position shift (PPS) value periodically caused by the relative eccentricity of the photosensitive drum and a driven gear, namely, more specifically, by changing the engaged positional relationship multiple times, from the position shift detection value of each variation in every multiple changes by varying the position of the detection pattern, as the position shift detection mark, on the carrying belt according to the relative phase difference of each photosensitive drum etc. so as to detect the PPS value at a number of positions.

SUMMARY

An image forming unit comprises an image supporter configured to be rotatable, and an amount detecting unit configured to rotate with a predetermined period to detect an amount of remaining developer, wherein a rotation period of the amount detecting unit is an integral multiple of a rotation period of the image supporter.

Also, an image forming apparatus related to the present invention comprises a plurality of image forming units, each of which includes, a rotation period detecting unit configured to rotate with a predetermined rotation period, and an image supporter configured to have a rotation period that is an integral multiple of the rotation period of the rotation period detecting unit, and to form a developer image by developer onto an electrostatic latent image formed by an exposing unit, and a print position shift detecting unit configured to detect a print position shift value between a pair of each of the image forming units from a position shift detection pattern formed on a predetermined recording medium by the pair of the image forming units, a rotation period sensing unit configured to sense a rotation period of the rotation period detection unit equipped to each of the image forming units, and a controlling unit configured to calculate an amount of rotation from a predetermined position of each of the image supporters using a sensing result of the rotation period sensing unit, and to calculate a correction value for which the print position shift becomes minimum from a detection result of the rotation period detecting unit and a calculation result of the amount of rotation.

According to the image forming apparatus of the present invention, a gear ratio from the photosensitive drum gear to a toner remaining gear is set so that a rotation period of the toner remaining gear is an integral multiple of a rotation period of the photosensitive drum gear, an eccentric position of the photosensitive drum gear and a toner remaining detection timing are installed with a predetermined phase angle. Image position correction values for each color can be obtained by detecting a position with respect to a phase angle of the photosensitive drum by an eccentricity of the photosensitive drum gear, the values minimizing relative position differences for each color.

DETAILED DESCRIPTION

First Embodiment

Initially, a tandem color electrophotographic image forming apparatus that employs an image forming apparatus related to the present invention is described based on an embodiment.

Figure 11:
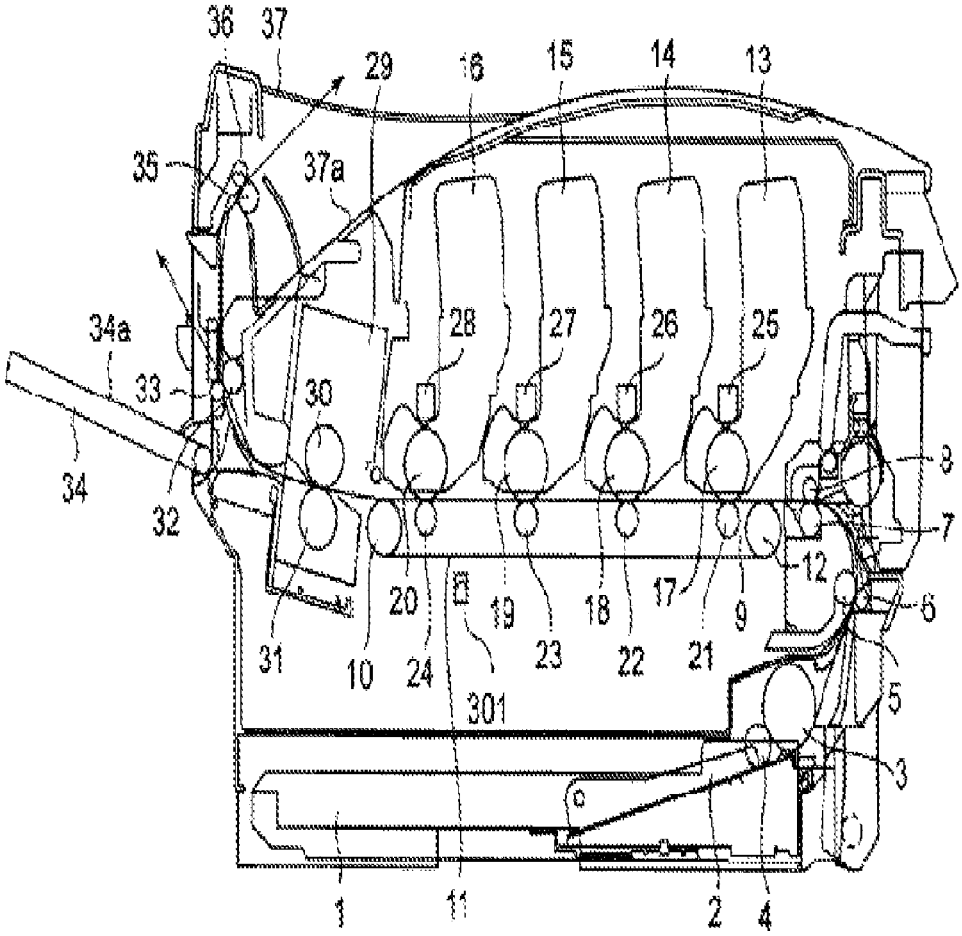
FIG. 11 illustrates of a tandem color electrophotographic image forming apparatus.

FIG. 11 illustrates tandem color electrophotographic image forming apparatus. A feeding path, by which a sheet is fed, printed, and ejected, and its configuration are described using FIG. 11 as an example.

In FIG. 11, a paper feeding roller 3 and a paper feeding sub roller 4, that are driven by a feeding motor (not shown), feed paper that is stored in a paper cassette 1 by a paper feeding power that is obtained from a sheet receiver 2 that is pushed up by a push-up spring (not shown). A feeding mechanism is configured to feed the paper fed from the paper cassette 1 to a transferring belt unit 9 with a paper feeding route guiding it using resist rollers 5 and 7 driven by the feeding motor (not shown) and pressure rollers 6 and 8 that coordinate and produce a feeding power by applying pressure on the resist rollers 5 and 7.

The transferring belt unit 9 is driven by a belt driving motor (not shown), feeds the paper, and is configured with a belt driving roller 10 that rotates a carrying belt 11 that is a recording medium and that conveys the medium on which a developer image formed in an ID unit (image drum (ID) unit) is transferred. The belt driving roller also rotates a belt driven roller 12 that rotates in synchronism with the carrying belt 11 and applies a tension to the carrying belt 11 so that the carrying belt 11 remains tight, and transferring rollers 21-24 that apply a transfer voltage to ID units 13-16 that are respective image forming units having photosensitive drums 17-20 that are image supporters for each C, M, Y, K color.

Also, the image forming apparatus is configured with exposing parts 25-28 that function as exposing units and that write electrostatic latent images on each of the photosensitive drums, a fusing unit 29 that heats and deposits toner that is transferred on the paper by a fusing roller 30 that is heated by a halogen lamp (not shown) and driven by a fusing motor (not shown) and a pressure roller 31 that coordinates with the rotation of the fusing roller 30, an ejection roller 32 and a coordinated ejection sub roller 33 that are driven by the fusing motor, an ejection roller 35 and a coordinated ejection sub roller 36 that is driven by the fusing motor that is used when a paper is ejected on a face down stacker 37*a* of a top cover 37, and a face up stacker 34.

Figure 12A:
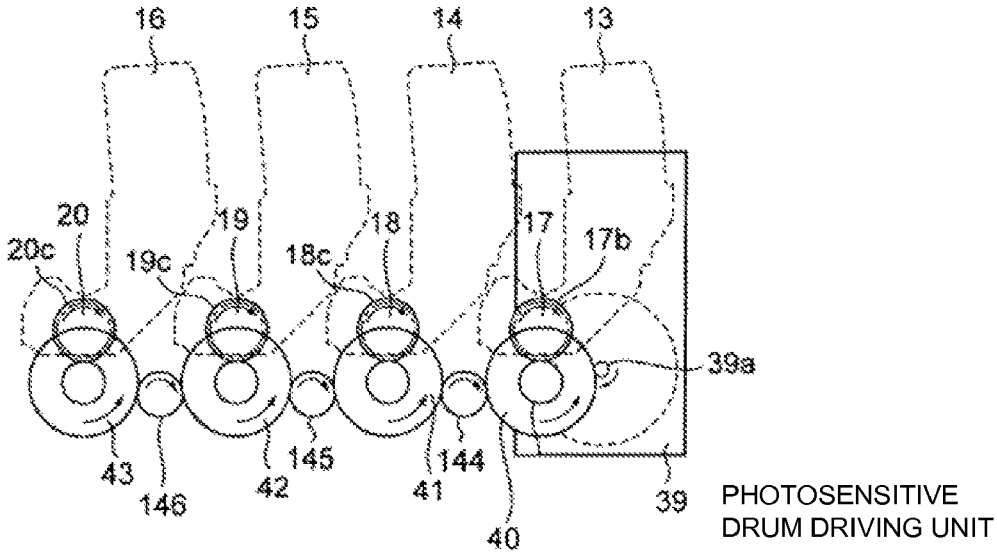
FIG. 12*a* illustrates a position of a photosensitive drum rotation driver.

Next, a rotation driver of a photosensitive drum of each color is described. FIG. 12*a* is a schematic view illustrating a position of a photosensitive drum rotation driver. An ID motor 39 (or photosensitive drum driving unit) is a driving source to rotate the photosensitive drums 17-20, and a gear unit 39*a* indicates the ID motor.

A rotation driving force is sequentially delivered to the photosensitive drum 17 in the ID unit 13(K) from the ID motor 39 to a first two-step driven gear 40, and a photosensitive drum gear 17*b* that is a driven gear of the photosensitive drum 17 in the ID unit 13(K).

Next, the rotation driving force is sequentially delivered to the photosensitive drum 18 in the ID unit 14(Y) from the ID motor 39 to the first two-step driven gear 40, a second driven gear 144, a first two-step driven gear 41, and a photosensitive drum gear 18*b* that is a driven gear connected to the photosensitive drum 18 in the ID unit 14(Y).

Similarly, the rotation driving force is sequentially delivered to the photosensitive drum 19 in the ID unit 15(M) from the ID motor 39 to the first two-step driven gear 40, the second driven gear 144, the first two-step driven gear 41, a second driven gear 145, a first two-step driven gear 42, and a photosensitive drum gear 19*b* that is a driven gear connected to the photosensitive drum 19 in the ID unit 15(M).

Similarly, the rotation driving force is sequentially delivered to the photosensitive drum 20 in the ID unit 16(C) from the ID motor 39 to the first two-step driven gear 40, the second driven gear 144, the first two-step driven gear 41, the second driven gear 145, the first two-step driven gear 42, a second driven gear 146, a first two-step driven gear 43, and a photosensitive drum gear 20*b* that is a driven gear connected to the photosensitive drum 20 in the ID unit 16(C).

Figure 12B:
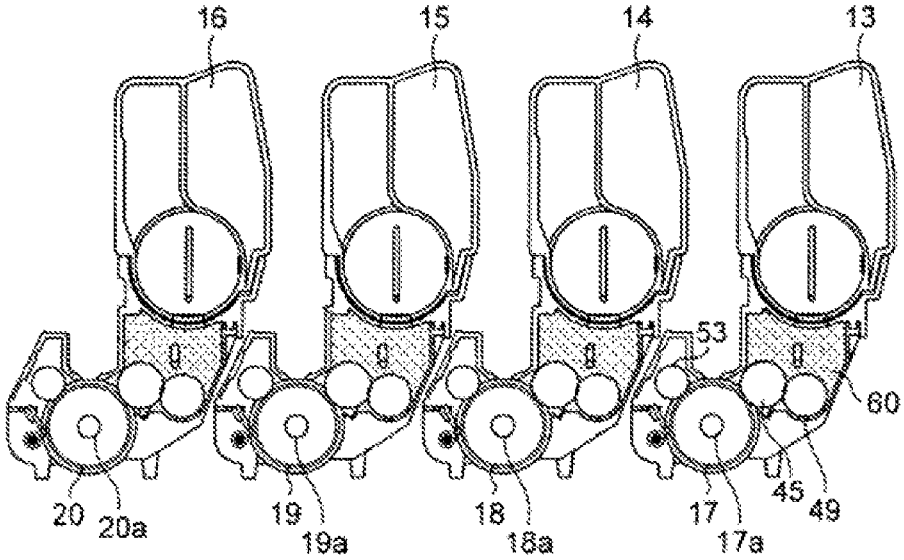
FIG. 12*b* illustrates a configuration inside each of the ID units.

FIG. 12*b* is a schematic view illustrating a configuration inside each of the ID units 13-16. In addition, the ID unit (K) 13 is described in detail as an example, as the other three ID units, the ID unit 14(Y), the ID unit 15(M), and the ID unit 16(C), have identical configurations.

The ID unit 13(K) is configured with the photosensitive drum 17 driven by an ID motor (not shown), a supplying roller 49 that charges uncharged toner 60 that is developer and supplies the toner to a developing roller 45, a charging roller 53 that charges the photosensitive drum 17, and a photosensitive drum shaft 17*a* that determines a position of the photosensitive drum 17. In this embodiment, the developer is described as a single compound. However, the developer may be composed of multiple compounds.

Next, an ID unit, that is an image forming unit in the present invention, is described in detail.

Figure 1:
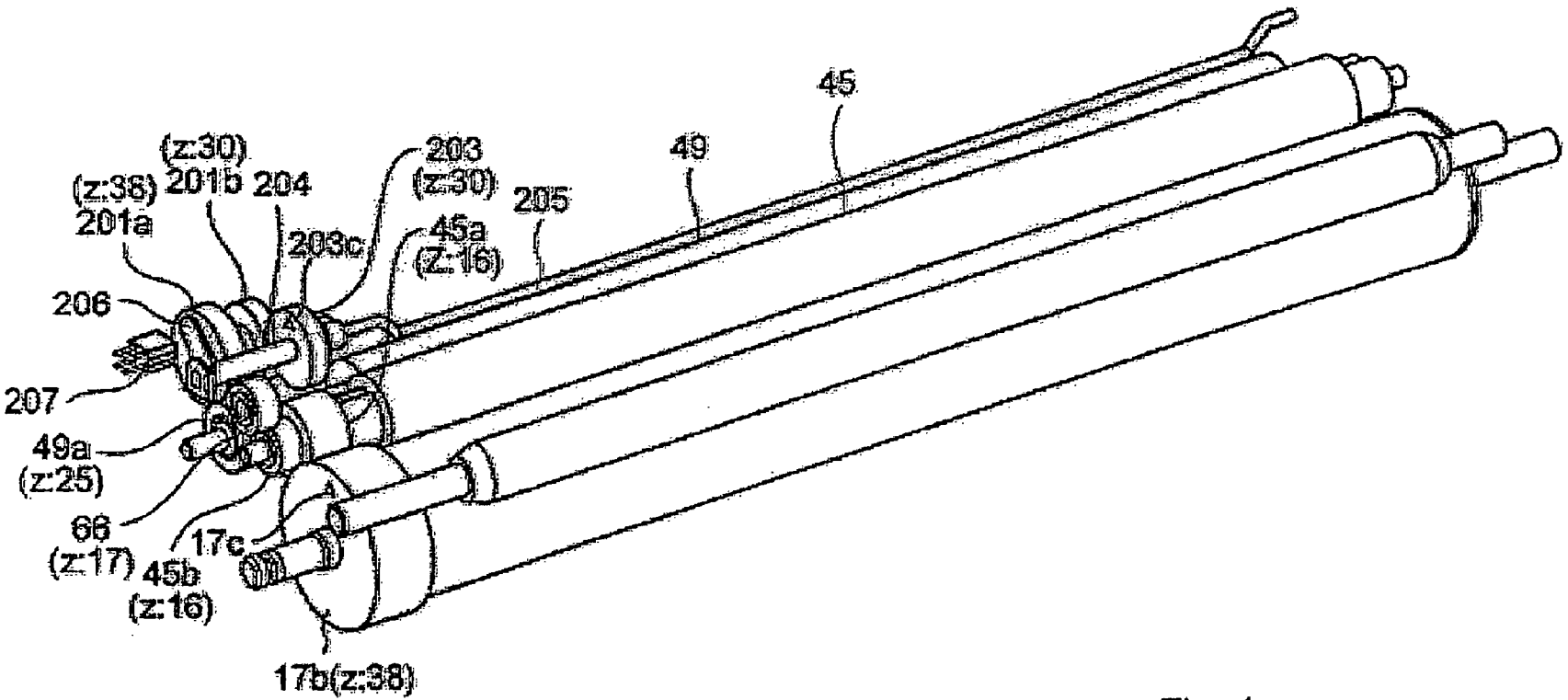
FIG. 1 is a view illustrating a configuration of one set of rollers and gears in an image drum (ID) unit (K) in the present invention.
Figure 6:
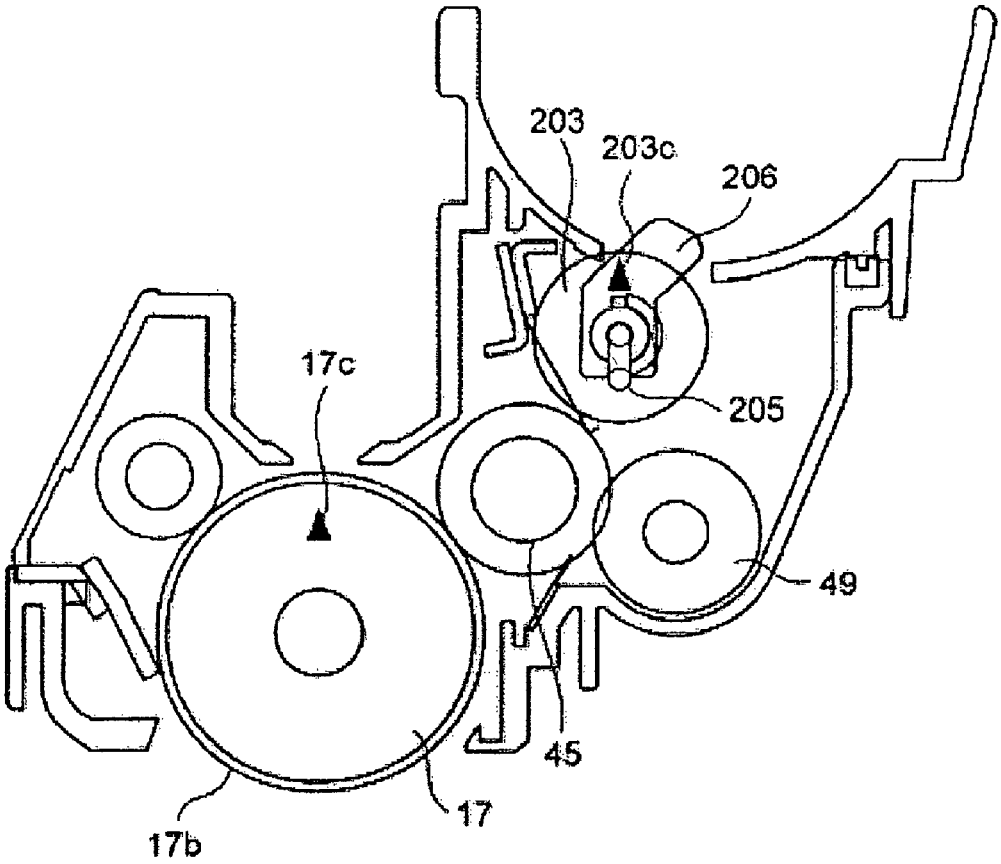
FIG. 6 illustrates an example in which a marking position written on a photosensitive drum gear and a phase angle of a toner amount gear that rotate a reflection plate fixed to a lever shaft become identical.

FIG. 1 is a view illustrating a configuration of rollers and gears in the ID unit 13(K). FIG. 6 is a view illustrating an example composed as phase angles of a position of a marking 17*c* made on a photosensitive drum gear 17*b* and a toner amount gear 203 that rotate a reflection plate 206 fixed to a lever shaft 205 become identical.

In addition, the ID unit 13(K) is described in detail as an example, as the other three ID units, the ID unit 14(Y), the ID unit 15(M), and the ID unit 16(C), have identical configurations.

A photosensitive drum gear 17*b* meshes with a developing roller gear 45*a* that is fixed to a developing roller 45, a developing roller gear 45*b* formed integrally with the developing roller gear 45*a* meshes with a supplying roller gear 49*a* fixed to a supplying roller 49 via a driven gear 66, and the supplying roller gear 49*a* meshes with a toner amount gear 203 rotatably attached to a lever shaft 204 via two gears, a gear 201*a* and a gear 201*b*, configured integrally with each other. A detection bar 205, that is configured with a metal part for detecting an amount of remaining toner, and a reflection plate 206 for detecting a rotation of the lever shaft 204, are fixed to the lever shaft 204. Both ends of the detection bar 205 are crank-shaped, and a center of gravity in the middle is different from that of the ends when a center of the shaft is configured to be a rotation center.

The photosensitive drum gear 17*b* includes a marking 17*c* indicating an eccentricity direction. A position of the marking 17*c* is determined based on an amount of eccentricity which is measured in advance. In addition, when the photosensitive drum gear 17*b* is a molded resin article, it becomes unnecessary to measure the gears respectively during a production process by measuring an amount of eccentricity and an eccentricity direction of some gears and making a marking to a molding tool since the amount of eccentricity and the eccentricity direction of the gears molded by the same molding tool become constant to some degree.

A position sensor 207, that is a rotation cycle sensing unit, is a reflective photosensor to detect that the lever shaft 204 is within a certain rotation angle range, and is equipped to a structure frame in a printer body (not shown) to correspond to each ID unit respectively.

Figure 2A:
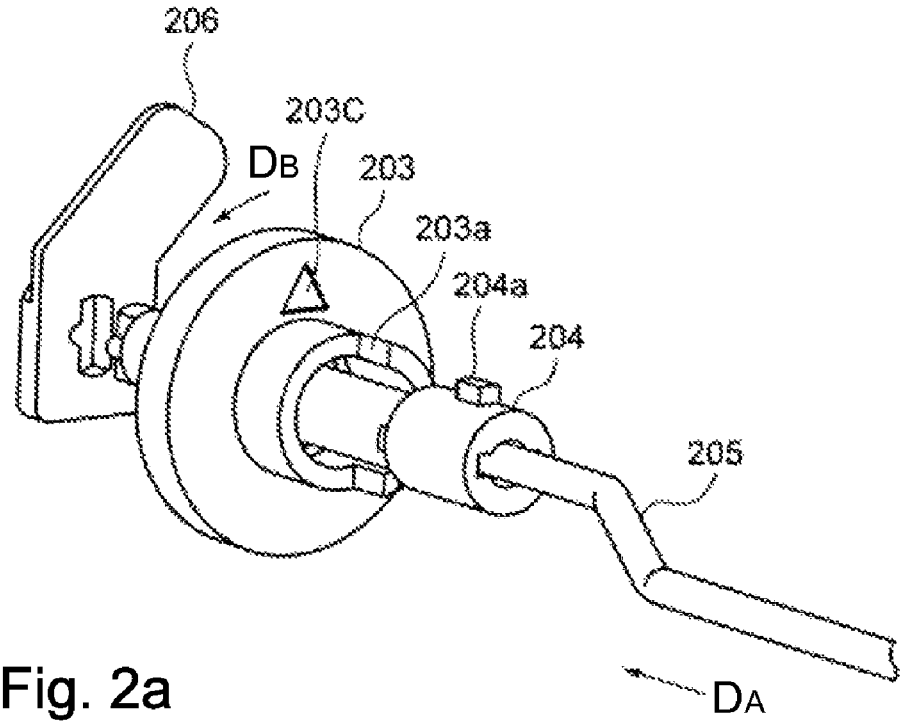
FIG. 2*a* is a perspective view of a main part of an amount detecting unit.
Figure 2B:
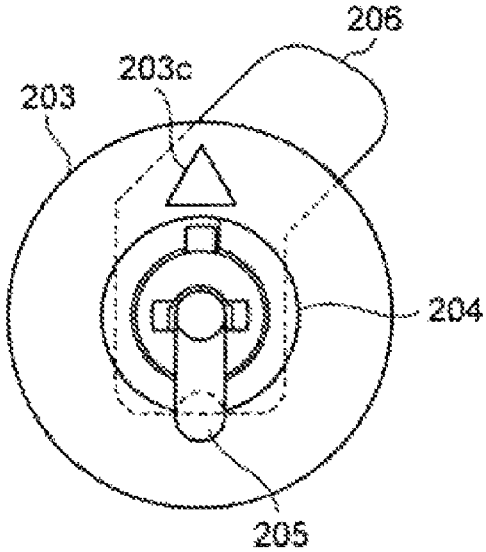
FIG. 2*b* is a fragmentary view of the amount detecting unit from the direction A in FIG. 2*a*.
Figure 3A:
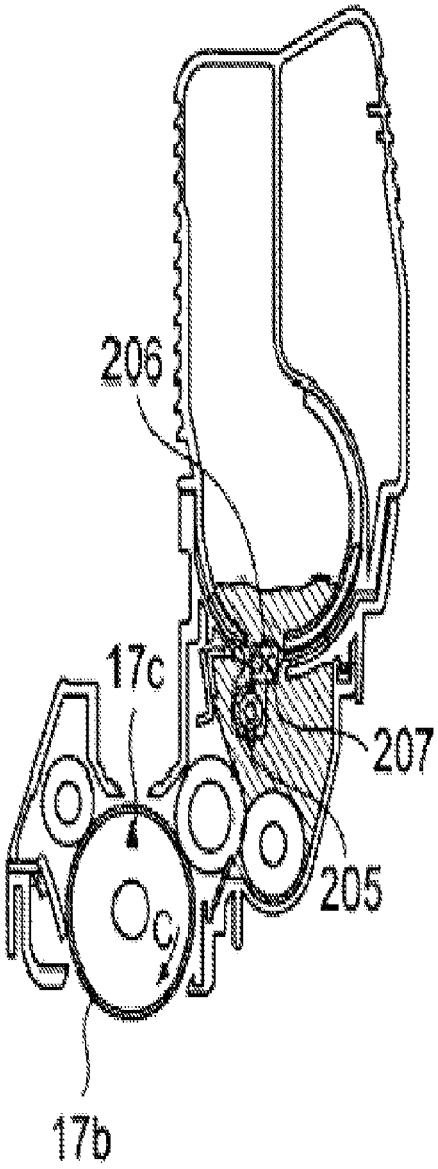
FIGS. 3*a*-3*d* illustrate operation of a lever shaft, a reflection plate, and a detection bar when a large amount of toner is remaining.
Figure 3B:
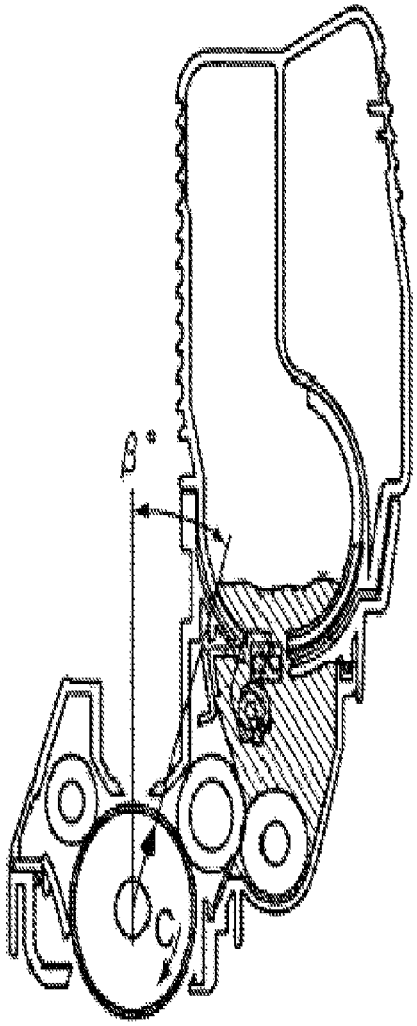
Figure 3C:
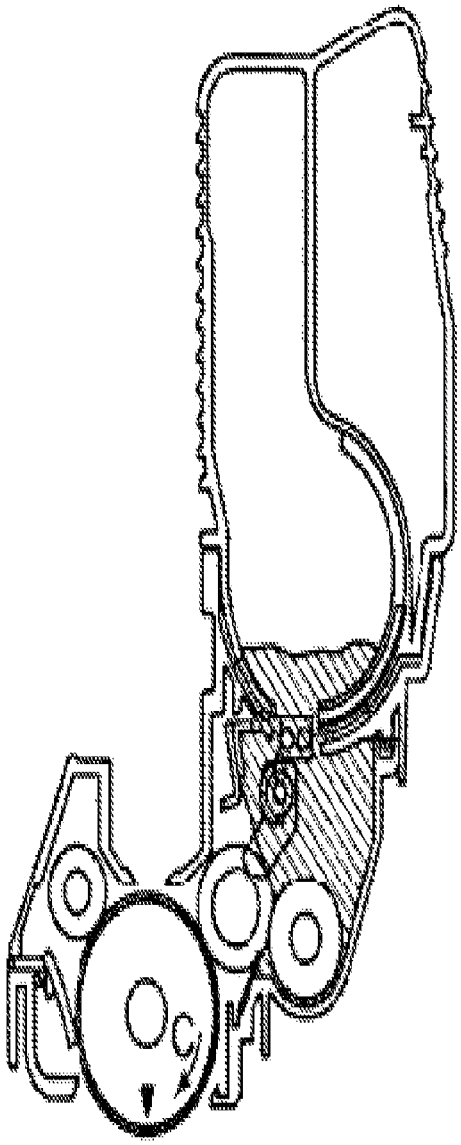
Figure 3D:
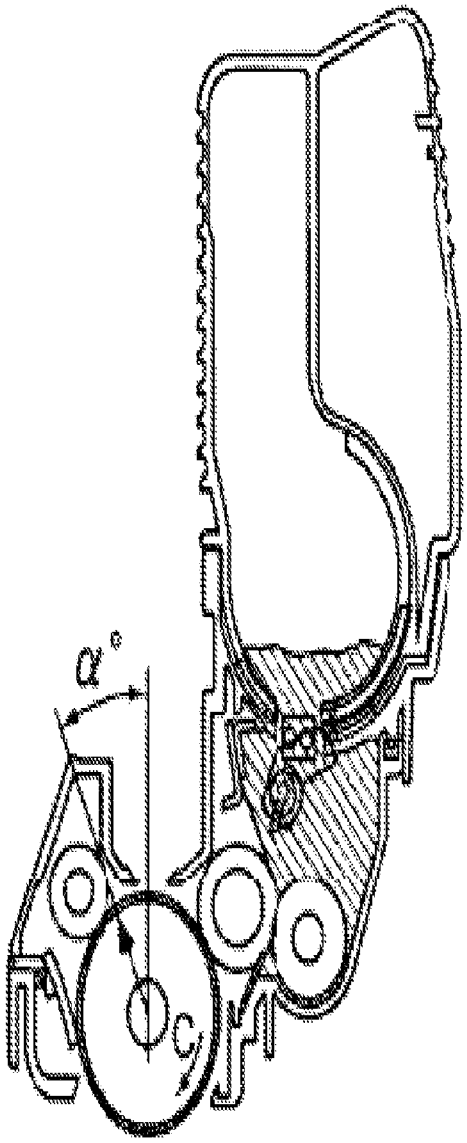

FIG. 2*a* is a perspective view of a main part of an amount detecting unit, and FIG. 2*b* is a fragmentary view from the direction $D_A$ of the amount detecting unit in FIG. 2*a*. A toner amount gear 203, that is attached rotatably to the lever shaft 204, has a semicircle-shaped rib unit 203*a*, and it engages with a projection unit 204*a* on the lever shaft 204. Also, a marking 203*c* is made in the upper part of the toner amount gear 203 at a position where the rib unit 203*a* is vertically oriented as shown in FIG. 2*b*.

A configuration described above allows the toner amount gear 203, the lever shaft 204, the detection bar 205, and the reflection plate 206 to be composed in identical angular relationship in a rotation direction of each member.

In addition, a reduction ratio between the photosensitive drum gear 17*b* and the toner amount gear 203 is set as a rotation cycle of the lever shaft 204 and is equal to an integral multiple of a rotation cycle of the photosensitive drum 17. The reduction ratio between the photosensitive drum gear 17*b* and the toner amount gear 203 is described in detail later. Furthermore, when the unit is assembled, a position of the marking 17*c* made on the photosensitive drum gear 17*b* is identical to a phase angle of the reflection plate 206 fixed to the lever shaft 204.

Following this, a print operation is described.

Figure 15:
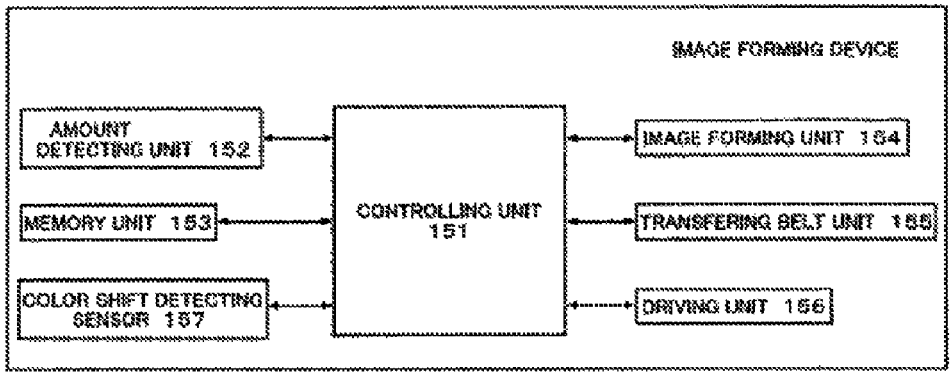
FIG. 15 is a schematic view illustrating a control block of the image forming apparatus.

Initially, an operation of a tandem color electrophotographic image forming apparatus is described. In addition, a control block of the image forming apparatus in the present invention is shown in FIG. 15. Each operation of the image forming apparatus in the present invention is controlled each operation by a controlling unit 151 attached to the apparatus body. An amount detecting unit 152 transmits information of an amount of remaining toner in each of the ID units 13-16. A memory unit 153 stores various kinds of setting information of the image forming apparatus and information of print data, etc. An image forming unit 154 forms a toner image, and a transferring belt unit 155 feeds a recording medium and transfers the toner image of the image forming unit to the recording medium. A driving unit 156 drives the image forming unit 154, the transferring belt unit 155, and a feeding unit, etc. A color shift detecting sensor 157 detects a color shift of the toner image formed on the transferring belt unit 155.

In FIG. 11, a top sheet on a sheet receiver 2 is separated from other sheets by a paper feeding roller 3. The top sheet is fed to a resist roller 5 and a coordinated pressure roller 6, and fed to a transferring belt unit 9 by the resist roller 5 and the coordinated pressure roller 6, and a resist roller 7 and a coordinated pressure roller 8. In the case of color print, a color image is formed by transferring a toner image formed on photosensitive drums 17-20 on the sheet that is fed on a carrying belt 11. In a black-and-white print, a black-and-white image is formed by not forming an electrostatic latent image on the photosensitive drums 18-20 that is in the ID units 14-16 except the ID unit 13(K) that forms a black-and-white image, and transferring an image formed on the photoconductor 17 in the ID unit 13(K). The toner image formed on the sheet is heated and deposited, and the sheet is ejected on a stacking unit 34*a* of a face up stacker 34 by an ejection roller 32 and an ejection sub roller 33. Also, when the face up stacker 34 is closed, the stacking unit 34*a* acts as a paper guiding unit, the sheet is ejected on a face down stacker 37*a* of a top cover 37 while being fed by an ejection roller 35 and an coordinated ejection sub roller 36 that are driven by the fusing motor. Next, an operation inside an ID unit is described with reference to FIG. 12*b* and FIG. 1.

Photoconductor drums 17-20, that is jointed to the photosensitive drum gears 17*b*-20*b* (Z=38; where Z is number of teeth) that obtains a rotation driving force from an ID motor 39 that is a photosensitive drum driving unit, is rotated. The photosensitive drum gear 17*b* drive rotatably a developing roller gear 45*a* (Z=16) jointed to a developing roller 45, and a developing roller gear 45*b* (Z=16) delivers a driving power to a supplying roller gear 49*a* (Z=25) jointed to a supplying roller 49 via a driven gear 66 (Z=17). The supplying roller gear 49*a* delivers a driving power to an agitating gear 201*a* (Z=38) configured to be a two-stage gear and engaged with an agitating bar (not shown), and drives a toner amount gear 203 (Z=30) via an agitating gear 201*b* (Z=30).

In addition, although a gear ratio of a gear configuration is a ratio of one to one to connect from the photosensitive drum gear 17*b* to the toner amount gear 203, the number of teeth of the gears and the gear ratios mentioned above may differ as long as a rotation cycle of the toner amount gear 203 is set to an integral multiple of that of the photosensitive drum gear 17*b*.

Next, a toner amount detecting operation is described using FIG. 2*a*, FIG. 2*b*, FIGS. 3*a*-3*d*, and FIGS. 4*a*-4*c*. When a toner amount gear 203 is driven by a photosensitive drum gear 17*b* via each gear in the direction of arrow $D_B$ shown in FIG. 2*a*, the top side of a semicircle-shaped rib part 203*a* equipped to the toner amount gear 203 and a projection unit 204*a*a equipped to the lever shaft 204 engage with each other, the lever shaft 204 rotates, and a reflection plate 206 and a detection bar 205 fixed to the lever shaft 204 rotate along with it. At the time, since a central axis of rotation becomes both edges (sides) of a detection bar 205, and the middle part of the detection bar 205 deviates from the central axis of rotation, a moment force is applied to the lever shaft 204, the reflection plate 206, and the detection bar 205 so as to position the detection bar 205 below the central axis.

An operation of a lever shaft 204 (shown in FIGS. 2*a* and 2*b*), a reflection plate 206, and a detection bar 205 in the state that large amount of toner remains is described referencing FIGS. 3*a*-3*d*. When a photosensitive drum 17 rotates in the direction of arrow C from the state of FIG. 3*a* and a toner amount gear 203 is driven by a photosensitive drum gear 17*b* via each gear, the lever shaft 204 and the reflection plate 206, and the detection bar 205 rotate in the direction as mentioned above. When the reflection plate 206 rotates β degrees to the position shown in FIG. 3*b*, it deviates from a facing position to a position sensor 207 and an output of the sensor becomes low level. The reflection plate 206 rotates additionally from the state of FIG. 3*c* to the state of FIG. 3*d*, that is α degrees before the state of FIG. 3*a*. And, since the reflection plate 206 rotates to a position facing the position sensor 207 again, the output of the position sensor 207 becomes high level. Therefore, when a rotation of the photosensitive drum 17 is defined as one, the output of the position sensor 207 when a large amount of toner remains is expressed as (α°=β°)/360=HIGH, (360−(α°=β°))/360=LOW.

Figure 4A:
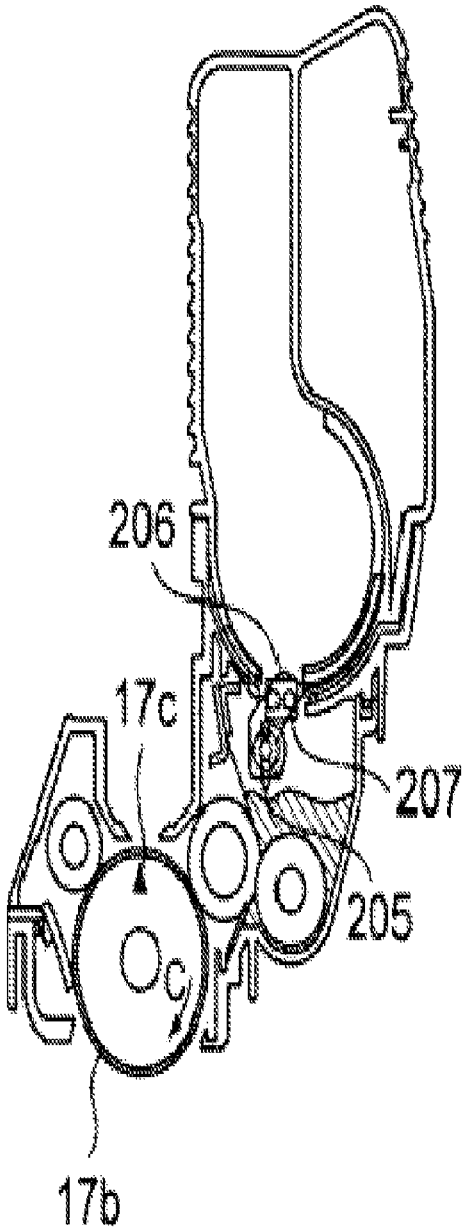
FIGS. 4*a*-4*c* illustrate operation of the lever shaft, the reflection plate, and the detection bar when a small amount of toner is remaining.
Figure 4B:
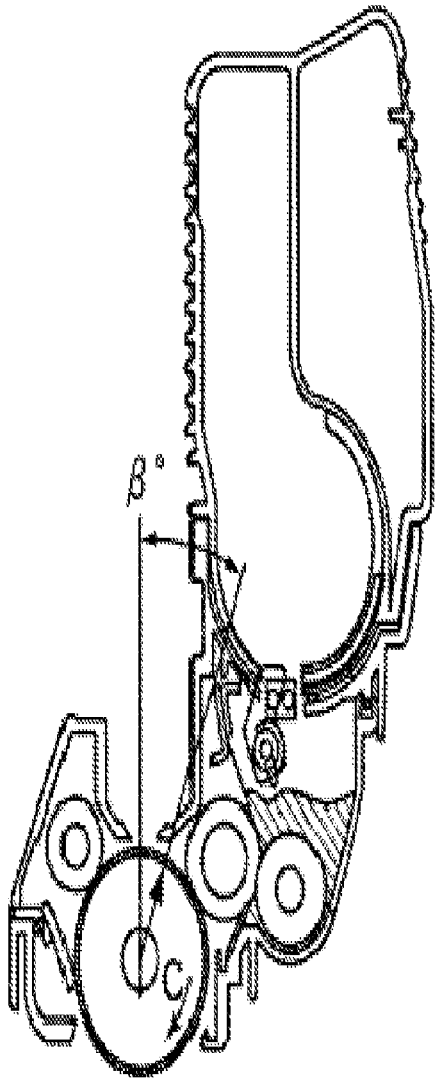
Figure 4C:
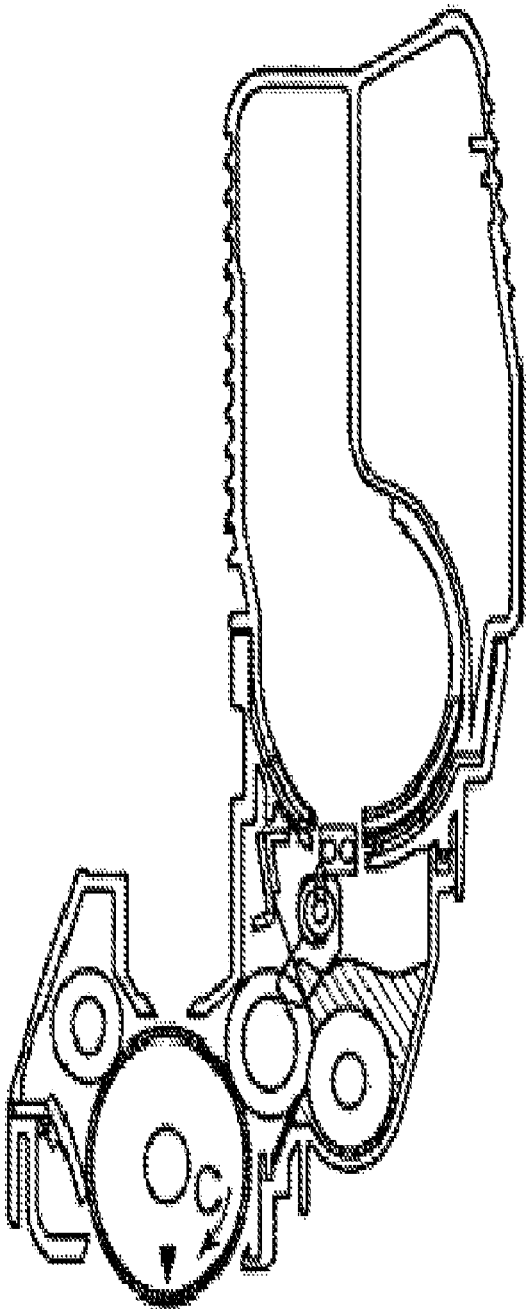

Next, an operation of a lever shaft 204 (shown in FIGS. 2*a* and 2*b*), a reflection plate 206, and a detection bar 205 when a large amount of toner remains is described using FIGS. 4*a*-4*c*. When a photosensitive drum 17 rotates in the direction of arrow C from the state of FIG. 4*a* and, when a toner amount gear 203 is driven by a photosensitive drum gear 17*b* via each gear, the lever shaft 204, the reflection plate 206, and the detection bar 205 rotate in the direction as mentioned above. When the reflection plate 206 rotates β degrees until it reaches the state of FIG. 4*b*, it deviates from a facing position to a position sensor 207 and an output of the sensor becomes low level. Additionally, rotating slightly from the state of FIG. 4*c*, the middle part of the detection bar 205 deviates from the central axis of rotation, a moment force is applied to the lever shaft 204, the reflection plate 206, and the detection bar 205 so as to position the detection bar 205 below the central axis, and the lever shaft 204, the reflection plate 206, and the detection bar 205 rotates 180 degrees to the state of FIG. 4*c*. Because of disengagement between the top side of the semicircle-shaped rib part 203*a* equipped to the toner amount gear 203 and the projection unit 204*a* equipped to the level shaft 204, the level shaft 204 rotates, and a reflection plate 206 and a detection bar 205 fixed to the lever shaft 204 rotate along with it. After that, the toner amount gear 203 rotates, and the top side of the semicircle-shaped rib part 203*a* and the projection unit 204*a* equipped to the lever shaft 204 engage with each other as shown in FIG. 4*a*.

As described above, when a rotation of the photosensitive drum 17 is defined as one, the output of the position sensor 207 when small amount of toner remains is expressed as (β°+180°)/360=HIGH, (180°−β°)/360=LOW.

Therefore, the outputs of the position sensor 207 above for a large amount of remaining toner and for a small amount of remaining toner result in differences of duty ratio between HIGH and LOW, that is an outputting time of HIGH and that of LOW. It can be determined like this that the amount of remaining toner becomes small in the ID units 13-16 by detecting the duty ratio between HIGH and LOW when the amount of remaining toner is large and when that is small.

As described above, four color image forming units are arranged in the feeding direction of a recording medium in a color image forming apparatus. The four color image forming units form images of each color, that is, black (K), yellow (Y), magenta (M), and cyan (C), in tandem on the recording medium. Therefore, a rotation unevenness occurs by an eccentricity of a photosensitive drum, a driving gear that drives the photosensitive drum, etc.

Next, calculation of a correction value that makes a color shift between each color smallest when a cyclic position shift occurs on the recording medium because of the rotation unevenness by the eccentricity of the photosensitive drum gear, is described.

A color shift detecting sensor 301, that is a PPS detecting unit shown in FIG. 11, is a reflective photosensor, and is a sensor for measuring a reflection intensity of a PPS detecting pattern printed on a carrying belt 11, and detecting the PPS value (hereinafter, defined as an identical concept to a color shift) of a plurality of ID units 13(K), 14(Y), 15(M), and 16(C).

A PPS value detecting method that uses a plurality of ID units, 13(K), 14(Y), 15(M), and 16(C), employed in the present embodiment is described here.

Figures 13A, 13B:
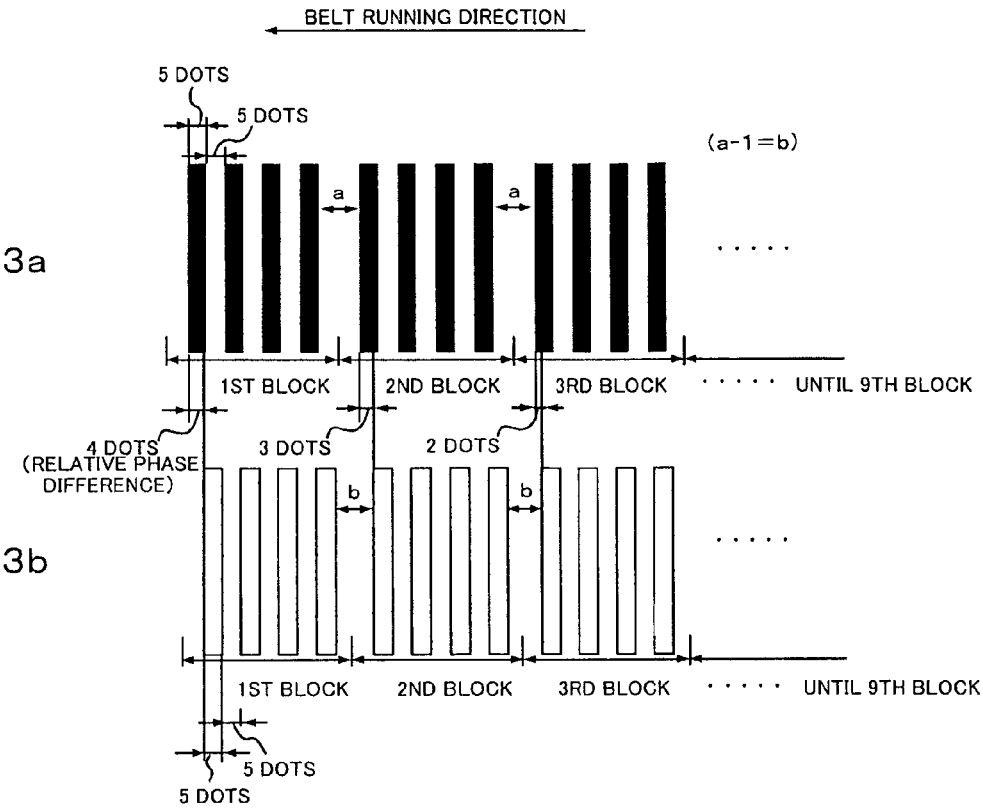
FIGS. 13*a* and 13*b* illustrate a PPS detection pattern that is a toner image.

FIGS. 13*a* and 13*b* illustrate a PPS detection pattern that is a toner image.

A detection pattern of black (K) as a basis of PPS is shown in FIG. 13*a*, and that of yellow (Y) that follows it is shown in FIG. 13*b*. In addition, although magenta (M) and cyan (C) form the detection pattern similarly, a PPS value detection of yellow (Y) is described as an example here.

The detection pattern of black (K) shown in FIG. 13*a* is a pattern of four five-dot-wide striped images formed perpendicularly at five dot intervals respectively in a vertical scanning direction. While defining the four striped patterns as one block, nine blocks are linearly arranged at constant intervals "a" in the vertical scanning direction.

The detection pattern of yellow (Y) shown in FIG. 13*b* starts four dots later than the detection pattern of black (K) in a relative phase difference, and is a pattern of four five-dot-wide striped images formed perpendicularly at five dot intervals respectively in the vertical scanning direction. While defining the four striped patterns as one block, nine blocks are linearly arranged at constant intervals "b" in the vertical scanning direction. In this regard, an interval b of the blocks in the detection pattern of yellow (Y) is set to be one dot narrower than that in the detection pattern of black (K).

Therefore, as for a relative position between the detection pattern of black (K) and yellow (Y), when the detection pattern of yellow (Y) is set to be four dots later than the detection pattern of black (K) in the relative phase difference at the uppermost stream (i.e., the first block) in a running direction of the carrying belt 11, the detection pattern of yellow (Y) starts three dots later than that of black (K) at a second block, and the detection pattern of yellow (Y) starts two dots later than that of black (K). Similarly, the detection pattern of yellow (Y) starts four dots earlier than that of black (K) at a ninth block.

Figure 10A:
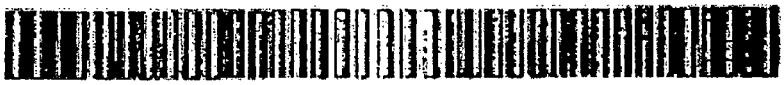
FIGS. 10*a* and 10*b* illustrate a result of PPS detection.
Figure 10B:
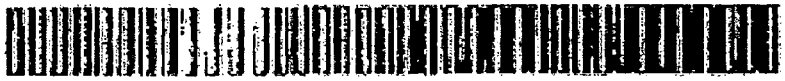

FIGS. 10*a* and 10*b* illustrate a result of PPS detection.

FIGS. 10*a* and 10*b* illustrates a detection pattern that the detection patterns of black (K) and yellow (Y) are printed in tandem by the ID unit 13(K) and the ID unit 14(Y.)

FIG. 10*a* illustrates a print result when there is no PPS between the ID unit 13(K) and the ID unit 13(Y). That is, the detection pattern of black (K) precedes at the uppermost stream location in the belt running direction (i.e., the first block), the detection pattern of yellow (Y) precedes at the most downstream location in the belt running direction (i.e., the ninth block), and the patterns of black (K) and yellow (Y) correspond with each other at the fifth block (i.e., the center block). Therefore, an area that appears directly on the surface of the carrying belt 11 and that has the highest optical reflectivity is larger than all other blocks. Also, since both the toner of yellow (Y) and the toner of black (K) formed below that merely cover the carrying belt 11 (that is, are not fused), the carrying belt 11 is not transparent. As a result, the output of the color shift detecting sensor 301 is largest at the position of the fifth block.

FIG. 10*b* illustrates a print result when the ID unit 13(K) shifts the position two dots in the running direction of the carrying belt 11 between the ID unit 13(K) and the ID unit 14 (Y). That is, the detection pattern of black (K) precedes at the uppermost stream in the running direction of the carrying belt 11 (i.e., the first block), and the detection pattern of yellow (Y) precedes at the most downstream in the running direction of the carrying belt 11 (i.e., the ninth block). The detection patterns of black (K) and yellow (Y) correspond with each other at the third block. A relative position shift value between the ID unit 13(K) and the ID unit 14(Y) can be detected by detecting a block that the detection patterns of black (K) and yellow (Y) correspond with each other from the print result reproduced in FIGS. 10*a* and 10*b* by using the color shift detecting sensor 301.

Similarly, the relative position shift between the ID unit 13(K) and ID unit 15(M), and the relative position shift between the ID unit 13(K) and ID unit 16(C) also can be detected.

Figures 5A, 5B:
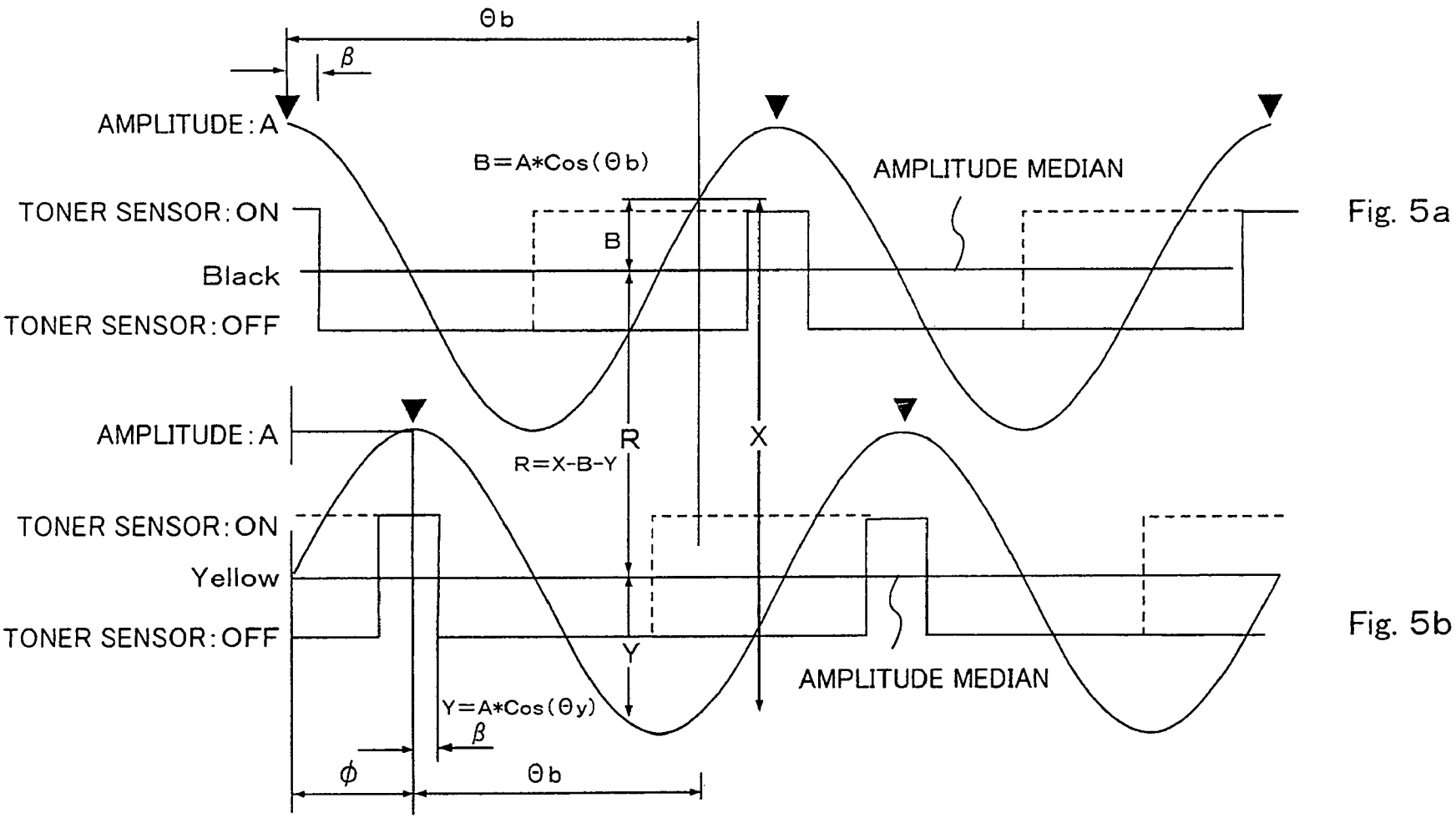
FIGS. 5*a*-5*b* illustrate examples of a cyclic position shift caused by an eccentricity of photosensitive drum gears of ID unit (K) and ID unit (Y).
Figure 14:
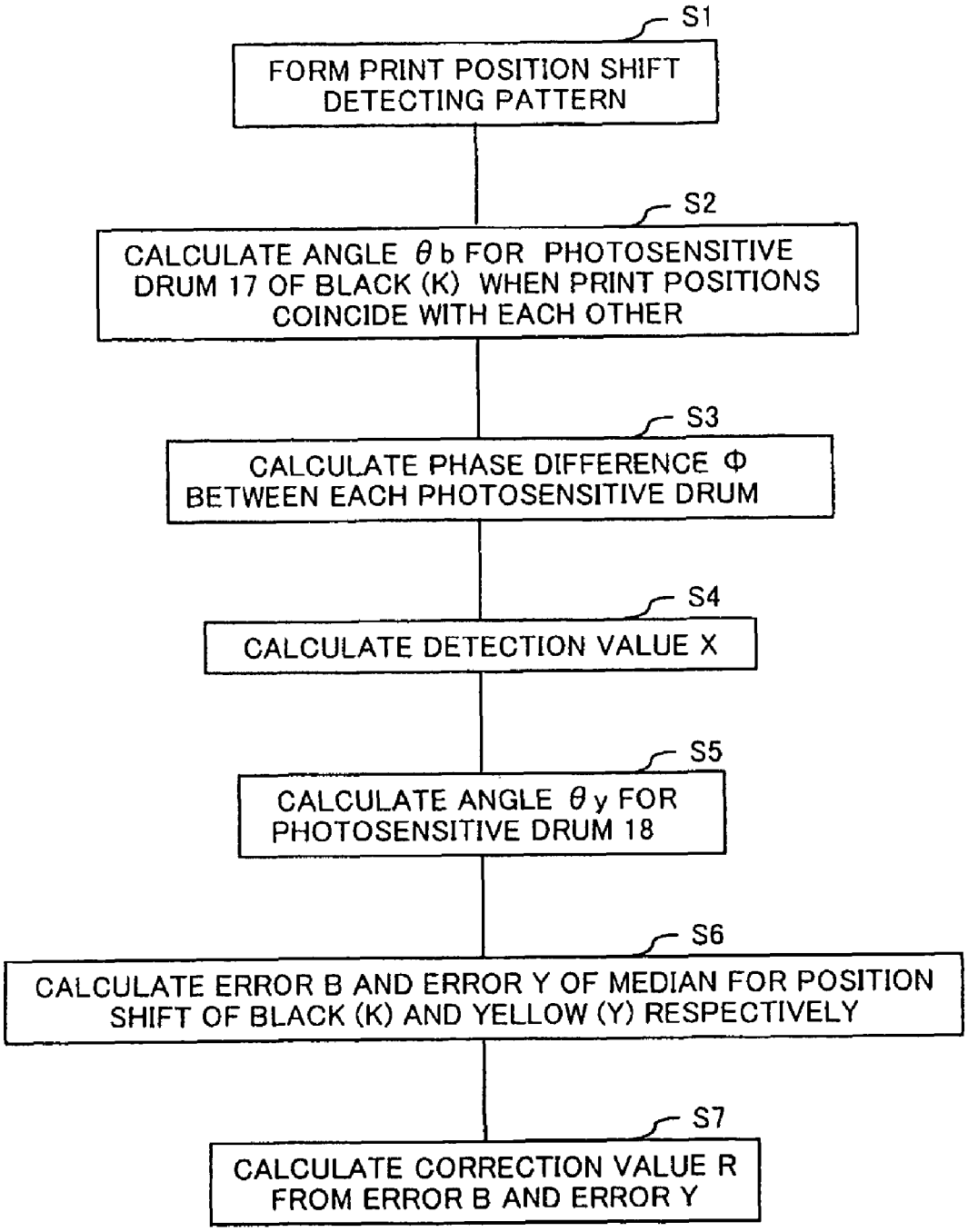
FIG. 14 is a flow diagram illustrating a calculation order of an image position correction value related to the first embodiment.

A method for calculating a correction value R of position shift of the present embodiment is described using a calculation of the correction value R between black (K) and yellow (Y) as an example. FIGS. 5*a* and 5*b* illustrates a cyclic position shift by an eccentricity of a photosensitive drum gear 17*b* of the ID unit 13(K) and a photosensitive drum gear 18*b* of the ID unit 14(Y). The curve shown in FIG. 5*a* shows an amplitude of PPS in an actual print of black (K), and the curve shown in FIG. 5*b* shows the amplitude of PPS in an actual print of yellow (Y). FIG. 14 is a flow diagram showing an operation of calculating the correction value R.

When calculating the correction value R, as mentioned above, a print position shift (PPS) detection pattern is formed on the carrying belt 11 at first (S1), and an angle θb of rotation of photosensitive drum 17 in the ID unit 13 (K) is calculated when the detection patterns of each color correspond (S2). The angle θb is calculated from a position of maximum amplitude A calculated by using a marking 17*c* equipped on the photosensitive drum gear 17*b*, that is, from the rotation amount of the photosensitive drum 17 from an eccentricity position of the photosensitive drum 17 to the position that the detection patterns correspond with each other.

When calculating the angle θb, the position sensor 207 that detects an amount of remaining toner is used. Since the position sensor 207 detects the reflection plate 206 driven by the toner amount gear 203 to determined a gear ratio to drive with a period of an integral multiple of the photosensitive drum gear 17*b*, the rotation of the reflection plate 206 and the rotating position of the photosensitive drum 17 constantly correspond, and the rotating position of the photosensitive drum 17 can be sensed by checking the rotation period of the reflection plate 206 without arranging an extra sensor to detect the rotating position of the photosensitive drum 17. In this regard, the maximum amplitude A and the phase angle of the change in output of the position sensor 207 are synchronized with each other with a shift of β degrees, where β is an angle shown in FIGS. 3*a*-3*d* and FIGS. 4*a*-4*c*.

Also, the forming of the PPS detection pattern changes the method of forming the PPS detection pattern according to a correction accuracy to be calculated. For example, when the correction accuracy is normal, the PPS detection patterns are printed in short intervals and plural times, and corresponding positions of the PPS detection patterns of each color at each point are detected. On the other hand, when the correction needs a very high accuracy, the PPS detection pattern is printed in long intervals, and the corresponding position of the PPS detection patterns of each color at a number of points.

Next, a phase difference ϕ between each photosensitive drum is calculated from each position of maximum amplitude A of the photosensitive drum 17 of black (K) and a photosensitive drum 18 of yellow (Y) (S3). In addition, since each photosensitive drum and each ID unit is configured by identical parts, and, as described above, the photosensitive drums produced by a same tool have nearly the same eccentricity position, the maximum amplitude A occurs in a nearly identical period.

A detection value X that is a relative position shift value of print between each color from a print position of the photosensitive drum 17 of black (K) when an angle is θb and a print position of the photosensitive drum 18 of yellow (Y) calculated by the angle θb and a phase difference Φ (S4).

Next, a rotated angle θy is calculated from the maximum amplitude A of the photosensitive drum 18 of yellow (Y) when the detection patterns of each color correspond with each other, by using an angle θb of the photoconductor 17 of black (K) and a phase difference ϕ in a rotation angle of the photosensitive drum 18 of yellow (Y) to the photosensitive drum 17 of black (K) (S5).

Next, an error B between a position shift of black (K) and a median curve of the position shift of black (K) and an error Y between a position shift of yellow (Y) and a median curve of the position shift of yellow (Y) at the angle θb are calculated by Eqs. 1 and 2 below (S6).

$$\text{Error } B = A(\text{Amplitude}) \times \text{Cos}(\theta b) \quad \text{Eq. 1}$$

$$\text{Error } Y = A(\text{Amplitude}) \times \text{Cos}(\theta y) \quad \text{Eq. 2}$$

Next, a correction value that a relative position shift of each color becomes minimum is calculated by Eq. 3 below, using the equations 1 and 2 above (S7).

$$\text{Correction Value } R = X(\text{Detection Value}) - (\text{Error } B + \text{Error } Y) \quad \text{Eq. 3}$$

An amount of position shift of median change of each amount of position shift of black (K) and yellow (Y) can be calculated by the correction value R obtained by the Eq. 3, and a relative position shift between black (K) and yellow (Y) can be made minimum by correcting a beginning point of yellow (Y) for the correction value R.

Similarly, the correction value R that the relative position shift between the ID unit 13(K) and the ID unit 15(M) and the relative position shift between the ID unit 13(K) and the ID unit 16(C) become minimum.

In addition, when an accuracy of calculating the correction value R is either a normal accuracy or a high accuracy, there is no need to print the PPS detection pattern while changing a relative phase difference of each photosensitive drum etc. in a number of times in the present embodiment. This is because the relative phase difference of each photosensitive drum is obtained by using a sensor that detects an amount of remaining toner as mentioned above in the present application. Therefore, toner consumption is reduced, and, furthermore, a position shift adjusting time can be shortened since there is no need to repeat a pattern print and a pattern sensing.

As mentioned above, a position shift of a photosensitive drum according to an eccentricity of a photosensitive drum gear can be detected by setting a gear ratio from the photosensitive drum gear to a toner amount gear in order for a rotation cycle to be an integral multiple of that of the photosensitive drum gear, and by incorporating an eccentricity position of the photosensitive drum gear in order for a toner amount detection timing to be in a given phase difference, and the correction value that the relative position shift of each color becomes minimum can be obtained when a position shift detection position between each photosensitive drum detects a position of a phase angle of the photosensitive drum gear in detecting the relative position shift value between photosensitive drums of at least two colors. By doing so, a time of a color shift correction can be shortened since there is no need to print a pair of toner marks for detecting an amount of position shift on a carrying belt while changing a relative phase difference of each photosensitive drum etc. a number of times in order to obtain a median change for an amount of position shift.

Also, consumption of toner can be reduced since the number of printing times of a pair of toner marks can be reduced.

Variation of First Embodiment

Next, a variation of the first embodiment in the present invention is described. In addition, the identical configurations to the first embodiment are identified by identical reference number, and an effect of the invention by having the identical configurations is assisted by the effect of the embodiment.

Although a gear ratio from a photosensitive drum gear 17*b* to a toner amount gear 203 is configured one to one in the first embodiment, a rotating operation of a detection bar 205 to detect an amount of remaining toner becomes unstable when a print speed is fast. In particular, when an amount of remaining toner is small, the upper end of a semicircle-shaped rib unit 203*a* equipped on a toner amount gear 203 and a projection unit 204*a* equipped on a lever shaft 204 are disengaged, the lever shaft 204 rotates and engages with the semicircle-shaped rib unit 203*a* equipped on the toner amount gear 203 again. The faster the rotation speed, and therefore the print speed, of a photosensitive drum gear 17*b*, the more unstable the operation becomes due to inertia of the detection bar 205. In addition, a change of print speed occurs when an image forming apparatus is switched between "normal quality (low print speed)" and "fine quality (high print speed)" according to a print quality as well as an increase of print speed in the development of high performance of the image forming apparatus.

Figure 7:
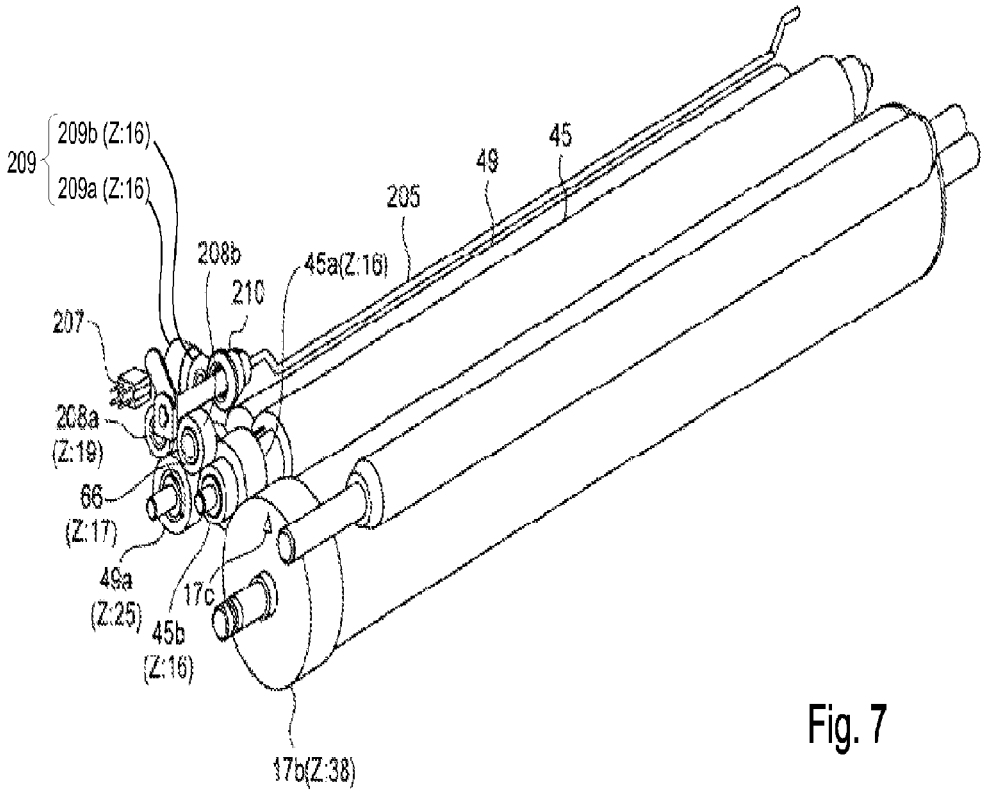
FIG. 7 illustrates an inside of an ID unit in a second embodiment as a variation of the first embodiment.

FIG. 7 is a configuration diagram inside of ID unit 13(K) as a variation of the first embodiment of the present invention. The present variation has a different gear configuration from the first embodiment, from a photosensitive drum gear 17*b* to a toner amount gear 203. In addition, since the other three ID units, that is ID unit 14(Y), ID unit 15(M), and ID unit 16(C), have a same configuration, the ID unit 13(K) is described in detail as an example.

Also, in the present variation, a high print speed is described as it is four times as fast as a normal print speed.

A photosensitive drum 17 connected to a photosensitive drum gear 17*b* (Z=38) that receives a rotation driving power by a photosensitive drum driving unit is rotated. The photosensitive drum gear 17*b* rotatably drives a developing roller gear 45*a* (Z=16) connected with a developing roller 45, and the developing roller gear 45*b* (Z=16) that is configured to be a two-step gear delivers a driving power to a supplying roller gear 49*a* (Z=25) connected with a supplying roller 49 via a driven gear 66 (Z=17). The supplying roller gear 49*a* delivers the driving power to a gear 208*a* (Z=19) that is configured to be two-stage gear and equipped with a worm gear 208*b*, and the worm gear 208*b* equipped on a gear 208 engages with a worm wheel 209*a* (Z=16) that has a certain spiral angle to engage a worm gear. A gear 209 includes a bevel gear unit 209*b* (Z=16) that drives a toner amount gear 210 (Z=16) that includes a bevel gear. In such a gear configuration, gear ratio from the photosensitive drum gear 17*b* to the toner amount gear 210 is connected in a ratio of 8:1.

The present variation is configured with an 8:1 gear ratio from the photosensitive drum gear 17*b* to the toner amount gear 210. Therefore, even if a rotation speed of the photosensitive drum gear 17*b* increases by a factor of four, the toner amount gear 210 and a lever shaft 204 rotates at one-eighth the speed of the photosensitive drum 17. Therefore, since the toner amount gear 210 rotates at a half speed compared with a speed where the gear ratio from the photosensitive drum gear 17*b* to the toner amount gear 210 is 1:1, a stable operation can be secured. Also, when a speed of the toner amount gear 210 decreases, accuracy of a detection of the amount of remaining toner can be improved, and also, accordingly, accuracy of an eccentricity phase detection of the photosensitive drum gear 17*b* can be improved.

As described above, since a rotation speed of a lever shaft 204, a reflection plate 206, and a detection bar 205 decreases even if a print speed becomes fast by configuring a gear ratio from a photosensitive drum gear 17*b* to a toner amount gear 210 to be an optimal ratio according to the print speed, the output of a toner sensor 207 becomes stable, detection of the amount of remaining toner becomes stable, and the accuracy of an eccentricity phase detection of the photosensitive drum gear 17*b* can be improved.

Second Embodiment

Next, the second embodiment in the present invention is described. In addition, identical configurations to the first embodiment are identified by identical reference numbers, and an effect of the invention by having the identical configurations is assisted by the effect of the embodiment.

Figure 8:
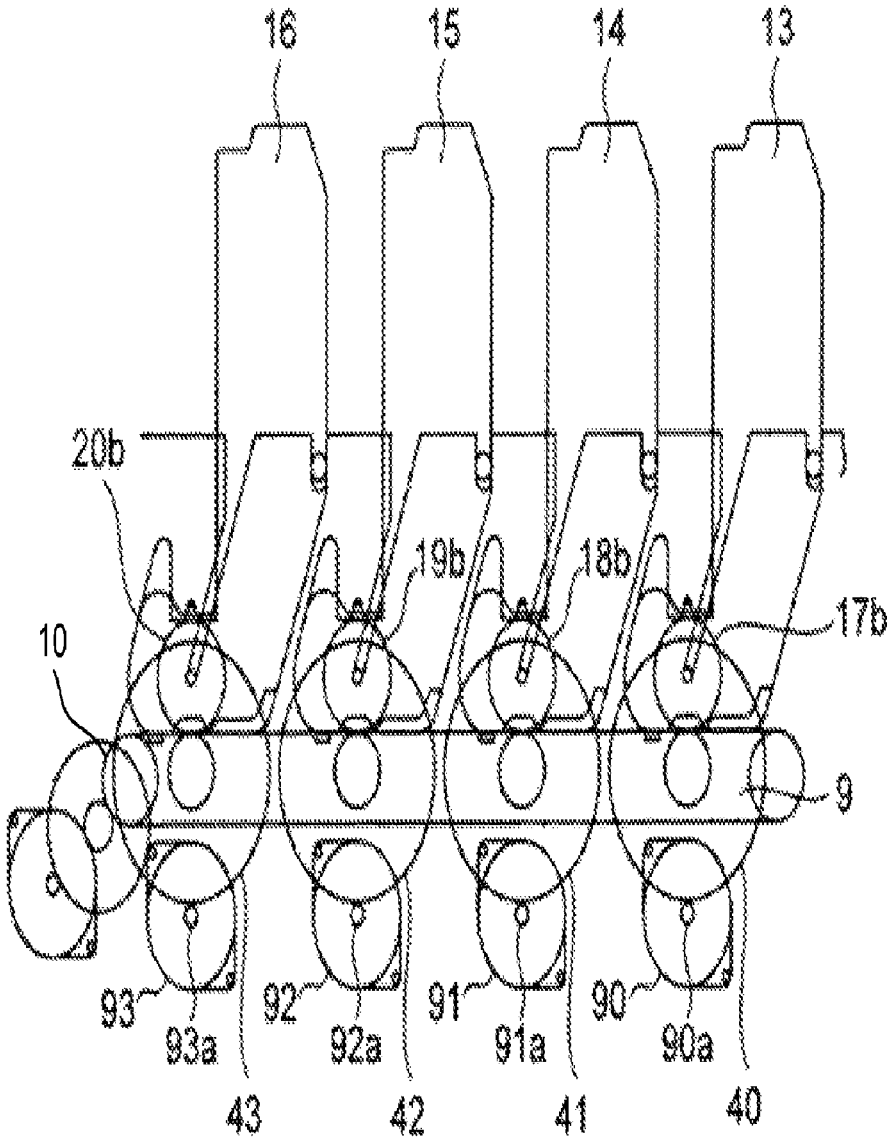
FIG. 8 illustrates a position of a photosensitive drum rotation driver in the second embodiment.
Figure 9:
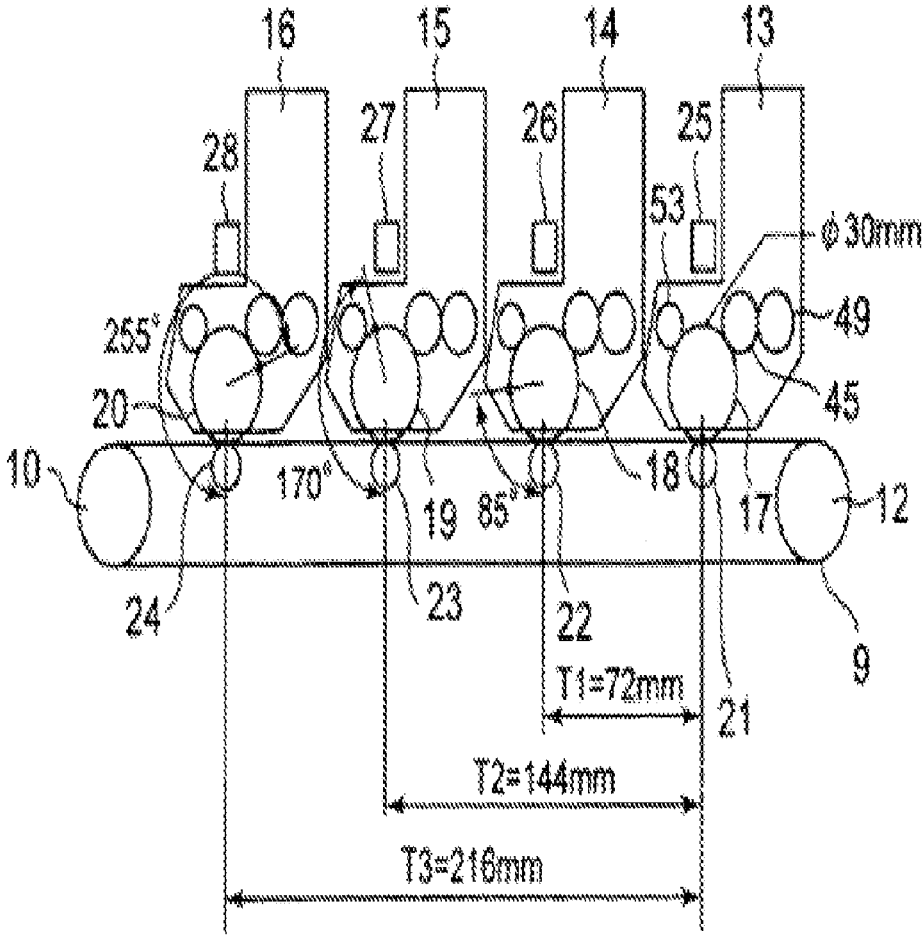
FIG. 9 illustrates a positional relation between a photosensitive drum of the ID units of each color and each transferring rollers included in a transferring belt unit in the second embodiment.

FIG. 8 illustrates a position of a photosensitive drum rotation driver in the present embodiment. FIG. 9 is a view illustrating a positional relationship between photosensitive drums 17-20 in each of ID units and transferring rollers 21-24 included in a transferring belt unit 9 in the present embodiment.

In FIG. 8, ID motors 90-93 that are driving sources to rotate photosensitive drums 17-20 and includes gear units 90*a*-93*a*. In the second embodiment, the rotation driver of the photosensitive drum of each color is different from that in the first embodiment.

The ID motor 90 delivers a rotation driving force to the photosensitive drum 17 in the ID unit 13(K) to a two-stage driven gear 40, and to a photosensitive drum gear 17*b* of the photosensitive drum 17 of the ID unit 13(K). In the ID units 14(Y)-16(C), similar to the ID unit 13(K), the rotation driving force is delivered to the photosensitive drums 18-20 from each of the ID motors 91-93 to the two-stage driven gears 41-43, and to the photosensitive drum gears 18*b*-20*b* of the photosensitive drums 18-20 of the ID units of each color.

In an image forming system in the present embodiment, since the photosensitive drums 17-20 of each color include an independent driving source, each of the photosensitive drums can be driven independently without being driven simultaneously with others.

As shown in FIG. 9, the photosensitive drums 17-20 are arranged in 72 mm intervals T1, T2, T3 in the feeding direction of a sheet supported on a transferring belt 11. Also, an outside diameter of each of the photosensitive drums 17-20 is 30 mm. Furthermore, a speed of a sheet being fed, that is a speed of a transferring belt 11, and a circumferential speed on a surface of each photosensitive drum are set at approximately the same speed. Therefore, a cycle of transferring an image formed by each of the photosensitive drums 17-20 on the sheet supported on the transferring belt 11 is set at approximately 94 mm.

When an interval of the photosensitive drums 17-20 and an outside diameter of the photosensitive drums 17-20 are set as described above, a phase difference of approximately 22 mm occurs between a rotation cycle of the photosensitive drums 17-20 and the interval of the photosensitive drums. Therefore, in order to match eccentricity phases of each of the photosensitive drum gears 17*b*-20*b* to minimize an influence of a rotation speed unevenness owing to the eccentricity of the photosensitive drum gear 17*b*, the photosensitive drum gear 18*b* is advanced by approximately 85 phase degrees relative to the photosensitive drum gear 17*b* of the ID unit 13 (K) (in other words, a printing process is started earlier by approximately 85 degrees) so as to match a speed change cycle at the position on the sheet that the images formed by the photosensitive drums 17 and 18 are transferred. Similarly, as to the ID unit 15 (M) and the ID unit 16 (C), the photosensitive drum gear 19*b* of the ID unit 15 (M) advances by approximately 85 phase degrees relative to the ID unit 14 (Y), and the photosensitive drum gear 20*b* of the ID unit 16 (C) advances by approximately 85 phase degrees relative to the ID unit 15 (M), so as to match a speed change cycle at the position on the sheet that the images formed by each of the photosensitive drums are transferred.

In addition, when the photosensitive drums of each ID unit are rotated, the photosensitive drums are rotated with the photosensitive drums and the transferring belt 11 touching each other. However, when a problem occurs, such as when the surface of the photosensitive drum is scratched, or when the transferring belt 11 sags, etc., problems occurring due to rotation with the photosensitive drums and the transferring belt 11 touching each other may be solved by moving the transferring belt 11 below using a mechanism (not shown) to divide the transferring belt 11 and the photosensitive drums and accordingly rotating the photosensitive drums.

Therefore, as described above, after a pattern of black (K) and patterns of each color are printed in tandem and a relative position shift value is detected between the ID unit 13 (K) and each of the ID units, the photosensitive drum gear 18*b* of the ID unit 14 (Y) is stopped at a position 85 degrees forward, the photosensitive drum gear 19*b* of the ID unit 15 (M) is stopped at a position 170 degrees forward, and the photosensitive drum gear 20*b* of the ID unit 16 (C) is stopped at a position 225 degrees forward, relative to the position that the photosensitive drum gear 17*a* of the ID unit 13 (K) is stopped, based on an output of a position sensor 207 to detect an eccentricity phase of each photosensitive drum gear, as well as detecting an amount of remaining toner. Accordingly, the speed change cycle for each of the photosensitive drums can be matched, and a cyclic position shift resulting from an eccentricity of each photosensitive drum gear can be decreased.

As described above, when an image forming apparatus includes independent driving sources for the photosensitive drums 17-20 of each color of each ID unit, the eccentricity phase for each of the photosensitive drum gears can be matched relatively to correspond the phases to each other at the position on the sheet that the images of each of the photosensitive drums are transferred based on the output of the position sensor 207 that detects a reflection plate 206 to detect an amount of remaining toner in each ID unit. Accordingly, a cyclic position shift resulting from an eccentricity of a photosensitive drum gear can be reduced, and a good print quality having is no color shift can be obtained.

Figure 16:
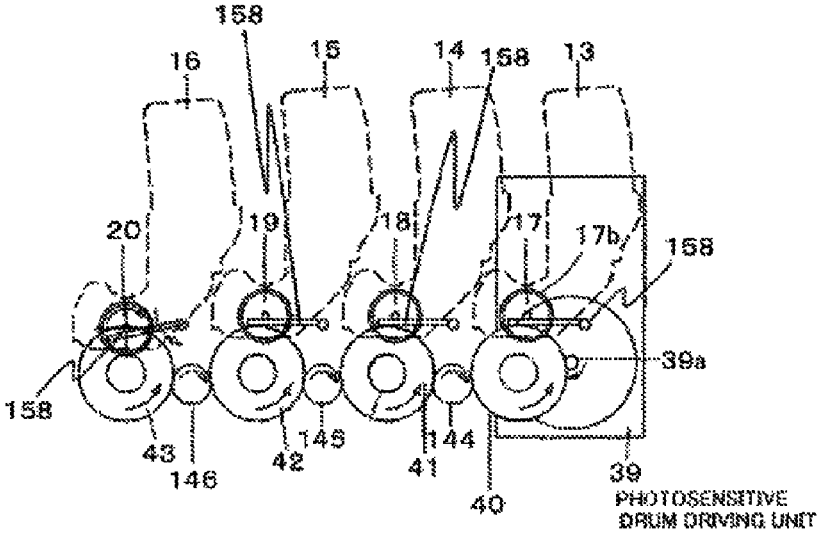
FIG. 16 illustrates another tandem color electrophotographic image forming apparatus.

In addition, although the present embodiment is described using the case that each of the photosensitive drums is driven by each of plural independent driving sources as an example, it can be applied to a case that each of plural photosensitive drums as in a configuration of the first embodiment is driven by a single driving source. For example, after detecting eccentricity phases of each photosensitive drum based on an output of a position sensor 207 of each ID unit, a controlling unit determines a photosensitive drum to be matched to the eccentricity phase, and determines a stopping position of the appropriate photosensitive drum. As shown in FIG. 16, by arranging a moving unit 158 that can move each of the photosensitive drums individually, the controlling unit divides each of the photosensitive drums from a transferring belt 11, that is a feeding surface of a sheet, moves the appropriate photosensitive drum individually to a print position to the transferring belt 11 by the moving unit 158, and rotatably drive the photosensitive drum to a stopping position. By executing this for each of the appropriate photosensitive drums, an effect similar to the second embodiment can be obtained.

What is claimed is:

1. The image forming unit, comprising:

an image supporter configured to be rotatable; and an amount detecting unit configured to rotate with a predetermined period to detect an amount of remaining developer, wherein a rotation period of the amount detecting unit is an integral multiple of a rotation period of the image supporter, and rotation periods of the image supporter and the amount detecting unit are configured to have a predetermined phase difference.

2. The image forming unit of claim 1, wherein the image supporter is a photosensitive drum.

3. The image forming unit of claim 1, wherein the image supporter comprises an image supporter gear configured to rotate the image supporter, and includes a marking that indicates a direction of eccentricity with respect to rotation of the image supporter.

4. The image forming unit of claim 3, wherein the marking and the amount detecting unit are installed with a predetermined phase difference.

5. An image forming apparatus comprising:

a plurality of image forming units according to claim 3;

a driving unit configured to be connected to the image supporter gear to rotatably drive the image supporter and the amount detecting unit in each of the image forming units; and a controlling unit configured to control image formation by each of the image forming units, each of the amount detecting units, and the driving unit, wherein the controlling unit is configured to calculate a relative position shift correction value from a print position shift value and an eccentricity position of each of the image supporter gears.

6. The image forming apparatus of claim 5, wherein the controlling unit is configured to calculate the print position shift value between a pair of the image forming units from a position shift detection pattern that is formed on a predetermined recording medium by each of the image forming units.

7. The image forming apparatus of claim 5, wherein:

the controlling unit is configured to detect the eccentricity position of the image supporter gear from the amount detecting unit.

8. The image forming apparatus of claim 7, wherein the controlling unit is configured to determine the relative position shift correction value based on a calculation of the relative print position shift value for which a change of the print position shift value becomes minimum from the position shift detection result and an eccentricity position detection result that is detected at the eccentricity position.

9. The image forming apparatus of claim 5, wherein the image forming apparatus comprises a plurality of the driving units, each being respectively engaged in one of the image forming units in the image forming apparatus.

10. The image forming apparatus of claim 9, wherein the controlling unit is further configured, to calculate the print position shift value between the plurality of image forming units from a period that an image formed on the image supporter is formed on a predetermined recording medium, to detect a rotation phase of each of the image supporters of the plurality of image forming units detected by the respective amount detecting units, and to set a rotation phase difference between each of a plurality of the image supporters so as to be minimum the change of the relative print position shift value.

11. The image forming apparatus of claim 9, wherein the image supporter for each of the image forming units is individually equipped with the driving unit.

12. The image forming apparatus comprising:

a plurality of image forming units, each of which includes a rotation period detecting unit configured to rotate with a predetermined rotation period, and an image supporter configured to have a rotation period that is an integral multiple of the rotation period of the rotation period detecting unit, and to form a developer image by developer onto an electrostatic latent image formed by an exposing unit;

a print position shift detecting unit configured to detect a print position shift value between a pair of each of the image forming units from a position shift detection pattern formed on a predetermined recording medium by the pair of the image forming units;

a rotation period sensing unit configured to sense a rotation period of the rotation period detection unit equipped to each of the image forming units; and a controlling unit configured to calculate an amount of rotation from a predetermined position of each of the image supporters using a sensing result of the rotation period sensing unit, and to calculate a correction value for which the print position shift becomes minimum from a detection result of the rotation period detecting unit and a calculation result of the amount of rotation, wherein the rotation period detecting unit is configured to be an amount detecting unit that detects an amount of developer in the image forming units by contacting the developer and departing from the developer during rotation.

13. The image forming apparatus of claim 12, wherein the controlling unit is configured:

to calculate a phase difference of a rotation angle of the image supporter of each of the image forming units from the amount of rotation of each of first and second image supporters, to calculate a position error of each of the image supporters from a detection result of the print position shift detecting unit, and to calculate the correction value by applying the position error of each of the image supporters to the detection result of the print position shift detecting unit.

14. The image forming apparatus of claim 13, wherein the image forming apparatus is configured to further include a driving unit that rotates the image supporter and the rotation period detecting unit.

15. The image forming apparatus of claim 14, wherein the controlling unit is configured to control a timing of exposing to the second image supporter by the exposing unit based on a calculation result of the correction value.

16. The image forming apparatus of claim 15, wherein the print position shift detecting unit is an optical sensor.

17. The image forming apparatus of claim 12, wherein the correction value is configured to be an eccentricity phase for the image supporters for each of the image forming units, and the controlling unit is configured to match the eccentricity phases of the image supporter for each of the image forming units to the recording medium according to an arrangement of each of the image forming units.

* * * * *